US011375795B2

(12) United States Patent
Uhlen et al.

(10) Patent No.: US 11,375,795 B2
(45) Date of Patent: Jul. 5, 2022

(54) CASE FOR A COSMETIC PRODUCT, IN PARTICULAR A POWDERY COSMETIC PRODUCT

(71) Applicant: ALBEA SERVICES, Gennevilliers (FR)

(72) Inventors: Pauline Uhlen, Levallois-Perret (FR); Daniel Carraro, Asnières sur Seine (FR)

(73) Assignee: Albea Services, Gennevilliers (FR)

( * ) Notice: Subject to any disclaimer, the term of this patent is extended or adjusted under 35 U.S.C. 154(b) by 556 days.

(21) Appl. No.: 16/432,884

(22) Filed: Jun. 5, 2019

(65) Prior Publication Data

US 2019/0365073 A1 Dec. 5, 2019

(30) Foreign Application Priority Data

Jun. 5, 2018 (FR) ..... 1854854

(51) Int. Cl.
*A45D 33/02* (2006.01)
*A45D 33/00* (2006.01)

(52) U.S. Cl.
CPC ..... *A45D 33/025* (2013.01); *A45D 33/003* (2013.01); *A45D 33/008* (2013.01); *A45D 2200/053* (2013.01)

(58) Field of Classification Search
CPC ... A45D 33/003; A45D 33/008; A45D 33/025
USPC ..... 132/299
See application file for complete search history.

(56) References Cited

U.S. PATENT DOCUMENTS 8,235,059 B2 * 8/2012 Pires ..... A45D 33/003 132/299
8,387,627 B2 * 3/2013 Yeom ..... A45D 33/06 132/307
8,839,803 B2 * 9/2014 Holloway ..... A45D 33/16 132/307

FOREIGN PATENT DOCUMENTS

FR 723214 4/1932
FR 2954056 6/2011

* cited by examiner

*Primary Examiner* — Jennifer C Chiang
(74) *Attorney, Agent, or Firm* — CRGO Global; Steven M. Greenberg

(57) ABSTRACT

A cosmetic product, in particular a powdery cosmetic product, includes a lid that is mounted rotationally mobile with respect to a base between at least one closed position and one open position of the case, first locking mechanism to lock the lid in a closed position, a dispensing device arranged between the lid and the base, and that is mounted rotationally mobile between at least one lowered position and one raised position, the dispensing device including a control member intended to be actuated to command the dispensing of the cosmetic product, and second locking mechanism to lock the dispensing device in the lowered position The control member of the dispensing device is configured to command the unlocking of the first locking mechanism of the lid and the unlocking of the second locking mechanism of the dispensing device.

15 Claims, 10 Drawing Sheets

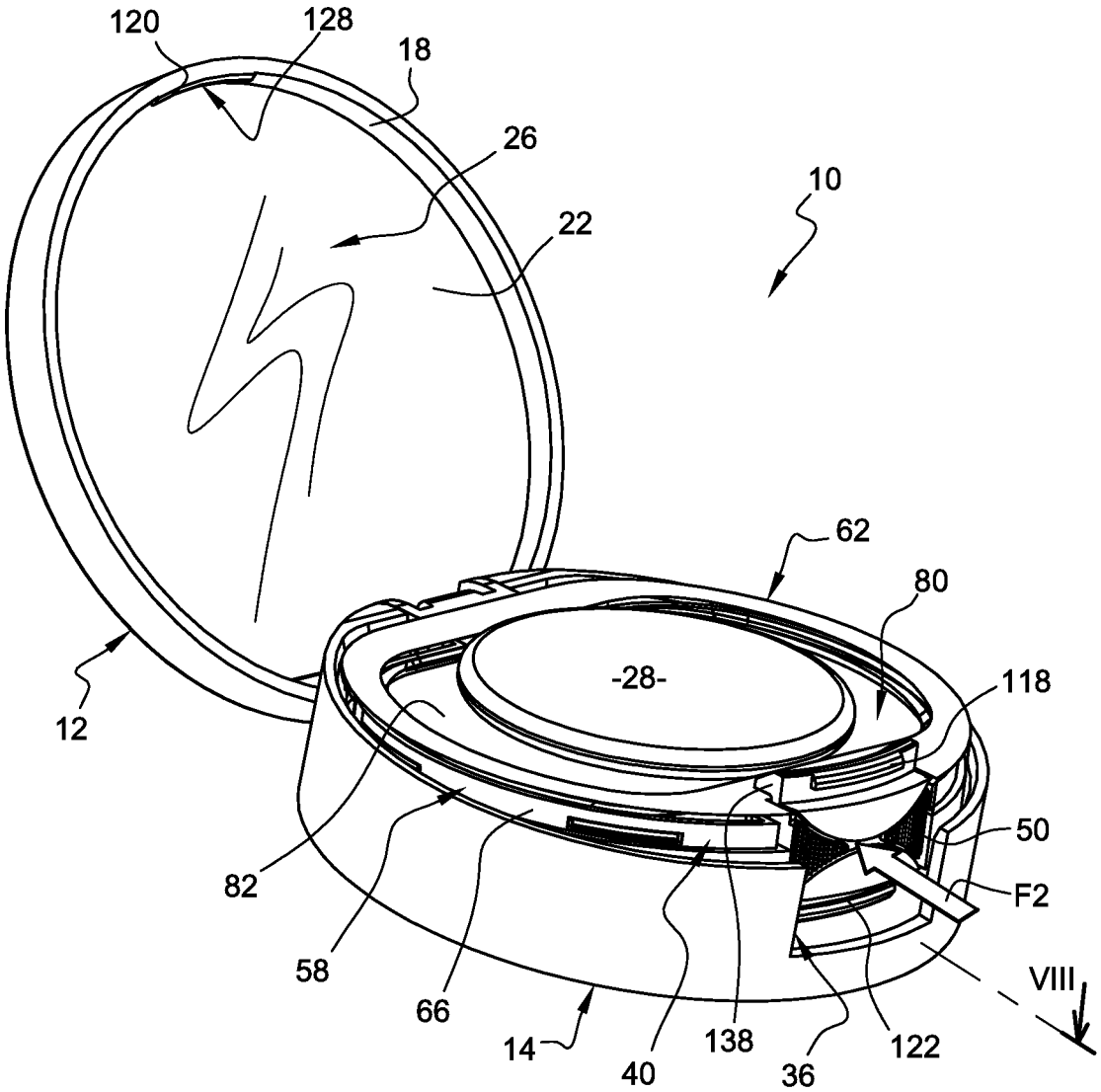
Fig. 7
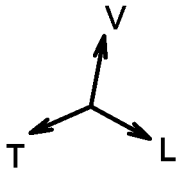

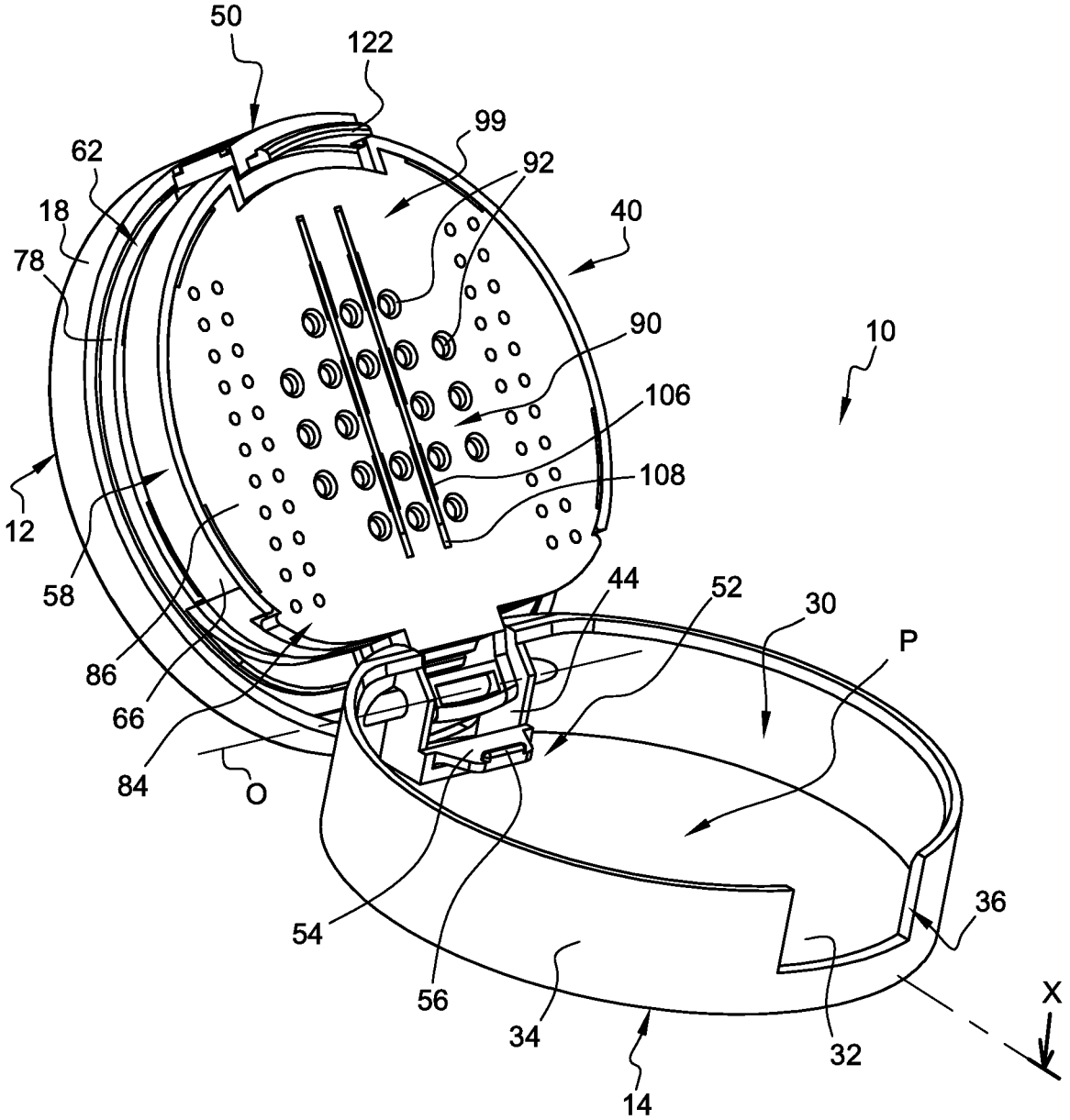
Fig. 9
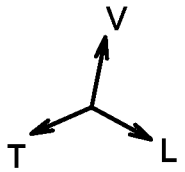

CASE FOR A COSMETIC PRODUCT, IN PARTICULAR A POWDERY COSMETIC PRODUCT

CROSS REFERENCE TO RELATED APPLICATIONS

This application claims priority under 35 U.S.C. § 119(a) to French Patent Application Serial Number 1854854, filed Jun. 5, 2018, the entire teachings of which are incorporated herein by reference.

BACKGROUND OF THE INVENTION

Field of the Invention

The invention relates to a case for a cosmetic product, in particular a powdery cosmetic product

Description of the Related Art

The state of the art discloses numerous examples of cosmetic product cases, in particular but not exclusively for the packaging of a powdery cosmetic product, such as powder or other similar products used for applying makeup.

According to a known design, the case for a cosmetic product includes a lid that is mounted rotationally mobile with respect to a base by articulation means such as a hinge, respectively from a closed position to at least one open position of the case.

Such a design presents the advantage of providing a case of which the lid is continuously connected to the base, so as to form one single assembly. When the lid contains a mirror, it makes it possible for the user to apply makeup with the help of the mirror, without having to hold the lid.

Therefore, such a case is to be distinguished from another well-known design, wherein the lid is removable, independent, with respect to the base, which involves a different opening gesture and furthermore presents disadvantages, such as having to find a surface to put the lid in an open position.

Such a case generally includes locking means that are configured to lock the lid in a closed position, in order in particular to prevent any unwanted openings, in particular during transportation.

Preferably, the locking means of the mechanical type are manually controlled, i.e. the unlocking of the lid is achieved selectively by actuating the button that commands the opening of the case.

The result is an associated opening gesture that is particular, as well as disadvantages such as the integration of such a button in the case so as to offer good ergonomics, while preserving the aesthetics or design of the case.

When such a case is intended for the packaging of a powdery cosmetic product, it is known to arrange inside the case, a dispensing device including dispensing means, for example a grid or a sieve through which the cosmetic product is dispensed.

However, the known dispensing means present various disadvantages among which are particularly the fact of not being able to selectively command the dispensing and also of not being able to accurately control the dispensed quantity of cosmetic product.

In addition, depending on the design of the case and of the dispensing device, there are other disadvantages, such as the risk of soiling, both during use and during transportation.

When the case includes an applicator, the applicator being in direct contact with the dispensed cosmetic product is then uncontrollably impregnated.

Thus, the presence of excess cosmetic product on the applicator is accompanied by the soiling of fingers during use and does not make it possible either for an accurate application of makeup.

There are also risks relating to the dispersion of the powdery cosmetic product out of the case when it is in a closed position.

The cases for cosmetic product known from the state of the art are therefore not entirely satisfactory.

BRIEF SUMMARY OF THE INVENTION

The purpose of the invention is, in particular, to propose a new design for a case including a dispensing device making it possible to solve, at least partially, the disadvantages of the state of the art, while having a case also presenting an easy handling, an pleasant aesthetic, and an accurate and reliable dispensing of cosmetic product. For this purpose, the invention proposes a case for a cosmetic product, in particular a powdery cosmetic product, including at least:

- a lid that is mounted rotationally mobile with respect to a base between at least one closed position and one open position of the case,
- first locking means to lock the lid in a closed position,
- a dispensing device which, arranged between the lid and the base, is mounted rotationally mobile with respect to the base between at least one lowered position and one raised position, the dispensing device including a control member intended to be actuated to command a dispensing of the cosmetic product,
- second locking means to lock the dispensing device in the lowered position, wherein the control member of the dispensing device is configured to command the unlocking of the first locking means of the lid and the unlocking of the second locking means of the dispensing device.

According to the invention, the case includes a single control member, described as "multi-purpose", to selectively command the unlocking of the first locking means of the lid and the unlocking of the second locking means of the dispensing device, as well as the dispensing of the cosmetic product.

Thanks to the presence of such a multi-purpose control member, the aesthetic quality (or design) of the case is improved, as it is advantageously more refined, in particular in comparison to a case that would include a button for each of the different functions.

Advantageously, the use of the case is also simplified with an actuating gesture on one single control member.

Advantageously, the case has good ergonomics since the unlocking function and the cosmetic product dispensing function are dissociated.

Indeed, thanks to the application of a different force on the member, each of the functions, respectively the unlocking function and the dispensing function, are selectively controlled.

Advantageously, the application of a first force on the control member causes the unlocking of the first locking means of the lid and of the second locking means of the dispensing device, preferably simultaneously, while the application of a second force, greater than the first force, causes the dispensing of the cosmetic product.

The application of the first force thus corresponds to a first motion of the control member, while the second force corresponds to a second motion of the control member, greater in distance than the first motion.

Thus, during an opening manipulation of the case, the unlocking of the first locking means of the lid and of the second locking means of the dispensing device is achieved by applying on the control member a force determined to be at least equal to the first force.

However, if the applied force is less than the second force, no dispensing of cosmetic product occurs, the only commanded function being the unlocking of the first locking means of the lid and of the second locking means of the dispensing device.

Advantageously, an opening manipulation of the case is not systematically accompanied by a dispensing of the cosmetic product, which is the reason why the unlocking and dispensing functions are called dissociated and selectively commanded.

Thanks to this dissociation, a closing manipulation of the case is also achieved independently, i.e. without dispensing the cosmetic product.

Advantageously, the closing of the case is likely to be obtained by one single movement, without actuating the control member, by applying in particular sufficient force on the lid to lower it in the closing direction in order to automatically cause the locking fingers to retract by engagement of technical forms.

Consequently, there is no systematic dispensing of cosmetic product for each actuation of the control member, the dispensing being selectively achieved based on the force applied to the control member.

Thus, it is, for example, possible to open the case for the sole purpose of using the mirror housed inside the lid or for a makeup adjustment using the cosmetic product present on the applicator and/or in the cavity (when not all of the cosmetic product previously dispensed has been used).

Advantageously, the dispensing of the cosmetic product is commanded independently from the double unlocking.

The application on the control member of a force at least equal to the second force is only performed when a dispensing of the cosmetic product is desired.

Thus, although it is possible to successively command the unlocking and the dispensing of the cosmetic product with one single and same gesture, the dispensing of cosmetic product can also be performed subsequently in a totally free manner, independently from the position of the first and second locking means.

The user is free to actuate the control member again, one or more times, to achieve the dispensing of additional amounts of cosmetic product, for example when the near-totality of previously-dispensed cosmetic product present in the cavity has been used.

Preferably, the unlocking of the first locking means of the lid and the unlocking of the second locking means of the dispensing device are performed simultaneously or in a substantially simultaneous manner.

Preferably, the dispensing device is configured to deliver a given dose of cosmetic product such that the quantity of cosmetic product is dispensed accurately, in a perfectly controlled manner.

Advantageously, the dose of cosmetic product is not delivered directly on the applicator but in a cavity of the base wherein the user then collects the required quantity of cosmetic product using the applicator.

Preferably, the case includes a space arranged between the lid and the dispensing device for storing the applicator, in particular in a closed position of the case, thanks to which the applicator is advantageously separated and isolated from the powdery cosmetic product.

Preferably, the case includes at least one mirror housed inside the lid.

Advantageously, the mirror and/or the applicator are arranged in a top part of the case, which is entirely separate from a lower part formed by the cavity of the base wherein is received the cosmetic product dispensed by the dispensing device.

The mirror and/or the applicator are thus preserved from risks of soiling by the cosmetic product. For the user, the case presents a better cleanliness because of this separation, ensuring the isolation of the cosmetic product in the cavity.

According to other characteristics of the invention:

- the dispensing device includes a reservoir intended to contain cosmetic product;
- the base includes a cavity intended to receive the cosmetic product dispensed by the dispensing device;
- the dispensing device is configured to selectively dispense a determined dose of cosmetic product;
- the lid is mounted rotationally mobile with respect to the base by means of first articulation means and the dispensing device is mounted rotationally mobile with respect to the base by means of second articulation means, the first articulation means and second articulation means presenting the same axis of rotation;
- the dispensing device includes at least:
- a bucket delimiting at least partially the reservoir and intended to contain the cosmetic product, which is closed by a cap, the bucket including a supply network formed by orifices in communication with the reservoir;
- a sieve including a dispensing network formed by orifices in communication with a cavity that the base includes, the orifices of the sieve being offset with respect to the orifices of the bucket so as to prevent a direct flow of the cosmetic product from the reservoir to the cavity that the base includes, and
- a dosage plate which, secured to the control member, includes a dosage network formed by through-orifices, the dosage plate being arranged between the bucket and the sieve and mounted mobile in translation between at least:

a dosage position wherein the orifices of the dosage network of the plate are aligned with the orifices of the supply network of the bucket to receive a dose of cosmetic product from the reservoir and a dispensing position wherein the orifices of the dosage network of the plate are aligned with the orifices of the dispensing network to dispense the dose of cosmetic product into the cavity;

- the dispensing device includes translational guide means of the dosage plate;
- the dosage plate is commanded to move from a dosage position towards a dispensing position by actuating the control member;
- the dosage plate is automatically returned towards the dosage position by elastic return means;
- the first locking means and the second locking means are commanded from a locked position to an unlocked position by actuating the control member;
- the first locking means and the second locking means are automatically returned to the locked position by elastic return means of the dosage plate;

the first locking means and/or the second locking means are configured to automatically lock when the case is closed by handling, without having to manually actuate the control member;

the cap includes a housing configured to receive all or part of at least one applicator of the cosmetic product;

the cap includes at least one transparent zone so as to make it possible to visually inspect, through the zone, the quantity of cosmetic product present in the reservoir of the dispensing device;

the dispensing device is configured such that the application of a first force, called unlocking force, on the control member, causes an unlocking of the first locking means and an unlocking of the second locking means and the application on the control member of a second force, called dispensing force, greater than the first unlocking force, causes the dispensing of the cosmetic product;

the application of the first unlocking force on the control member simultaneously causes the unlocking of the first locking means and of the second locking means;

the lid includes at least one mirror that is secured inside the lid;

the dispensing device includes abutment means that intervene when the dosage plate reaches the dispensing position;

the upper locking pin includes a frustoconical surface and/or the associated notch of the lid includes a frustoconical surface and/or the lower locking pin includes a frustoconical surface and/or the associated notch of the base includes a frustoconical surface;

the cap is secured to the bucket, either so that it cannot be removed, or so that it can be removed, to make it possible to refill the reservoir with cosmetic product;

the application of the second dispensing force, greater than the first unlocking force, on the control member, causes the dispensing of a dose of cosmetic product.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIGS. 7 and 8 are respectively a perspective view and a cross-sectional view along the vertical VIII-VIII plane of longitudinal orientation that represent the case after the lid has been rotationally driven to a second open position, called "maximum opening", for the purpose of using the mirror and/or the applicator, and that illustrate the application of a second dispensing force on the control member of the dispensing device—which has remained in the first raised position—to cause the distribution of a dose of powdery cosmetic product in the cavity of the base;

FIGS. 9 and 10 are respectively a perspective view and a cross-sectional view along the vertical X-X plane of longitudinal orientation that represent the case after the dispensing device has been rotationally driven to a second raised position and that illustrate the cavity of the base including the dose of powdery cosmetic product that has just been dispensed by the dispensing device.

DETAILED DESCRIPTION OF THE INVENTION

In the following description, in a non-limiting manner, the longitudinal, vertical and transversal orientations are used with reference to the trihedron (L, V, T) represented in FIGS. 1 to 10.

Conventionally, the longitudinal and transversal directions are determined in a fixed manner with respect to the base of the case such that the open or closed position of the lid of the case has no effect on the longitudinal and transversal orientations.

Also in a non-limiting manner, the terms "upper" and "lower" are used with reference to the vertical orientation of the trihedron (L, V, T). In addition, the terms "inner or internal" and "outer or external" are respectively used with respect to the case and, generally, to describe an element located either inside or outside of the case.

Also conventionally, the terms "front" and "rear" are used with reference to the longitudinal orientation of the trihedron (L, V, T), the case opening by a rotation of the case from front to back about the rotation axis O arranged at the rear of the case.

The terms "left" and "right" are used with reference to a transversal orientation of the trihedron (L, V, T).

The terms "upstream" and "downstream" are used with reference to the flow of cosmetic product, which is from upstream to downstream.

The figures represent a case 10 for a cosmetic product according to an embodiment of the invention provided by way of a non-limiting example.

In this embodiment, the cosmetic product is a powdery cosmetic product P, for example powder, which is represented by dots in the figures.

Such as illustrated in FIGS. 1 to 10, the case 10 presents, in a non-limiting manner, a general cylindrical shape.

As a variant, the case 10 can present another shape, notably of a parallelepiped, in particular a square or rectangular shape.

Figure 1:
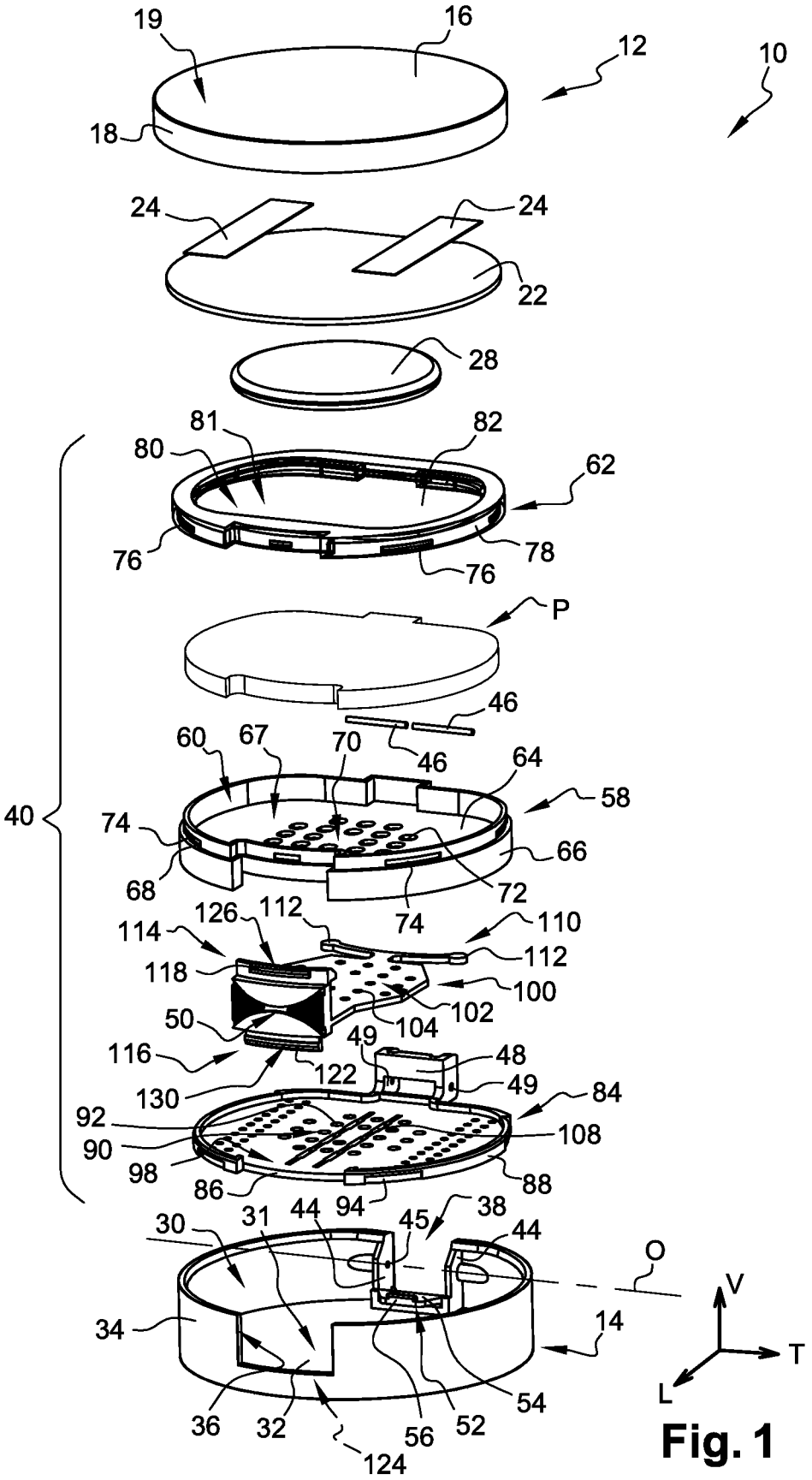
FIGS. 1 and 2 are perspective, three-quarter views, respectively front and rear, that represent, in an exploded view, a case for a powdery cosmetic product including a lid, a base and a dispensing device of the cosmetic product according to an embodiment of the invention and that illustrate the various constituting parts thereof.
Figure 2:
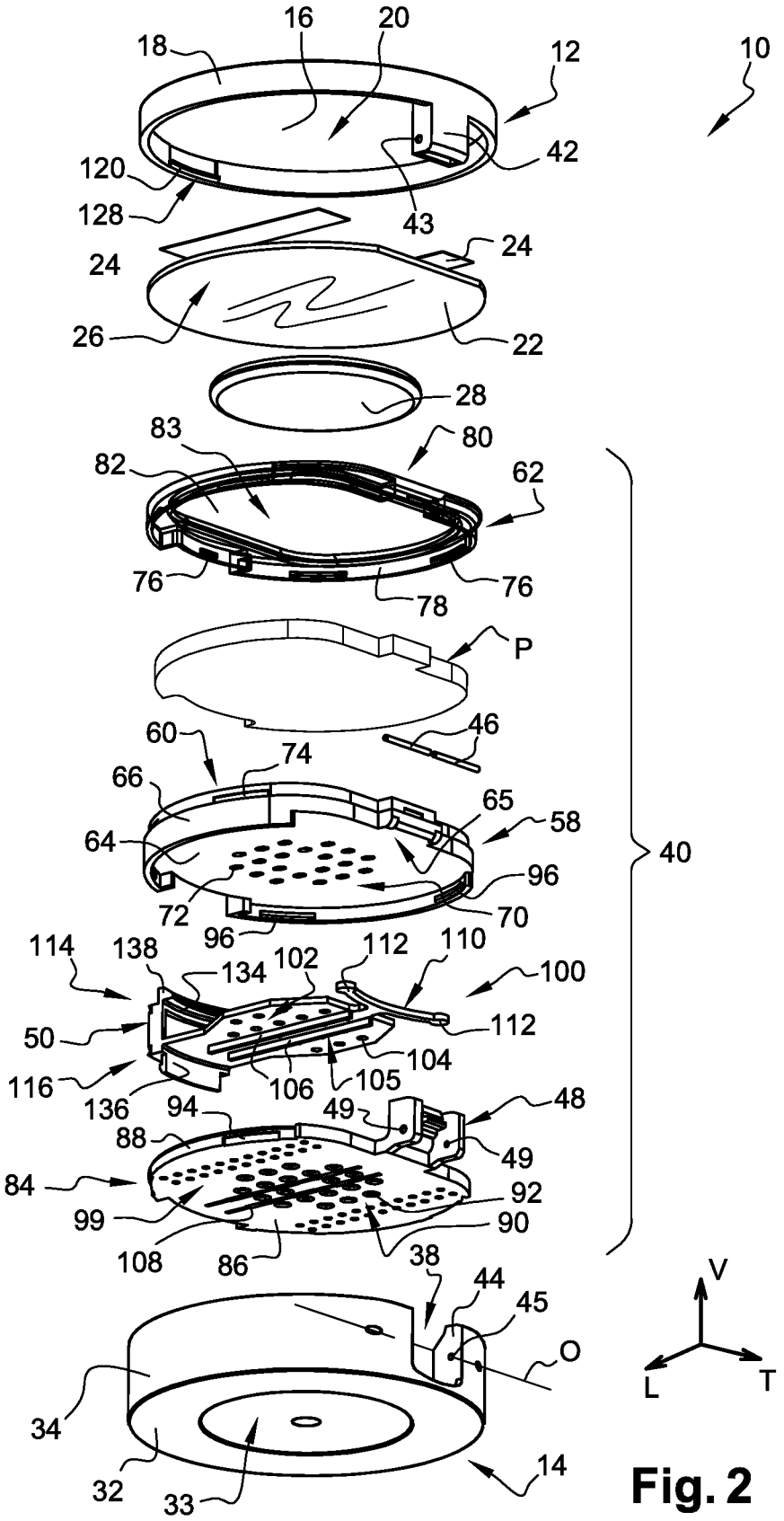

A description is provided below of the various constituting parts of the case 10 according to the embodiment, the parts being more specifically illustrated in an exploded view in FIGS. 1 and 2.

The case 10 includes a lid 12 and a base 14 that are of complementary shapes.

Figure 5:
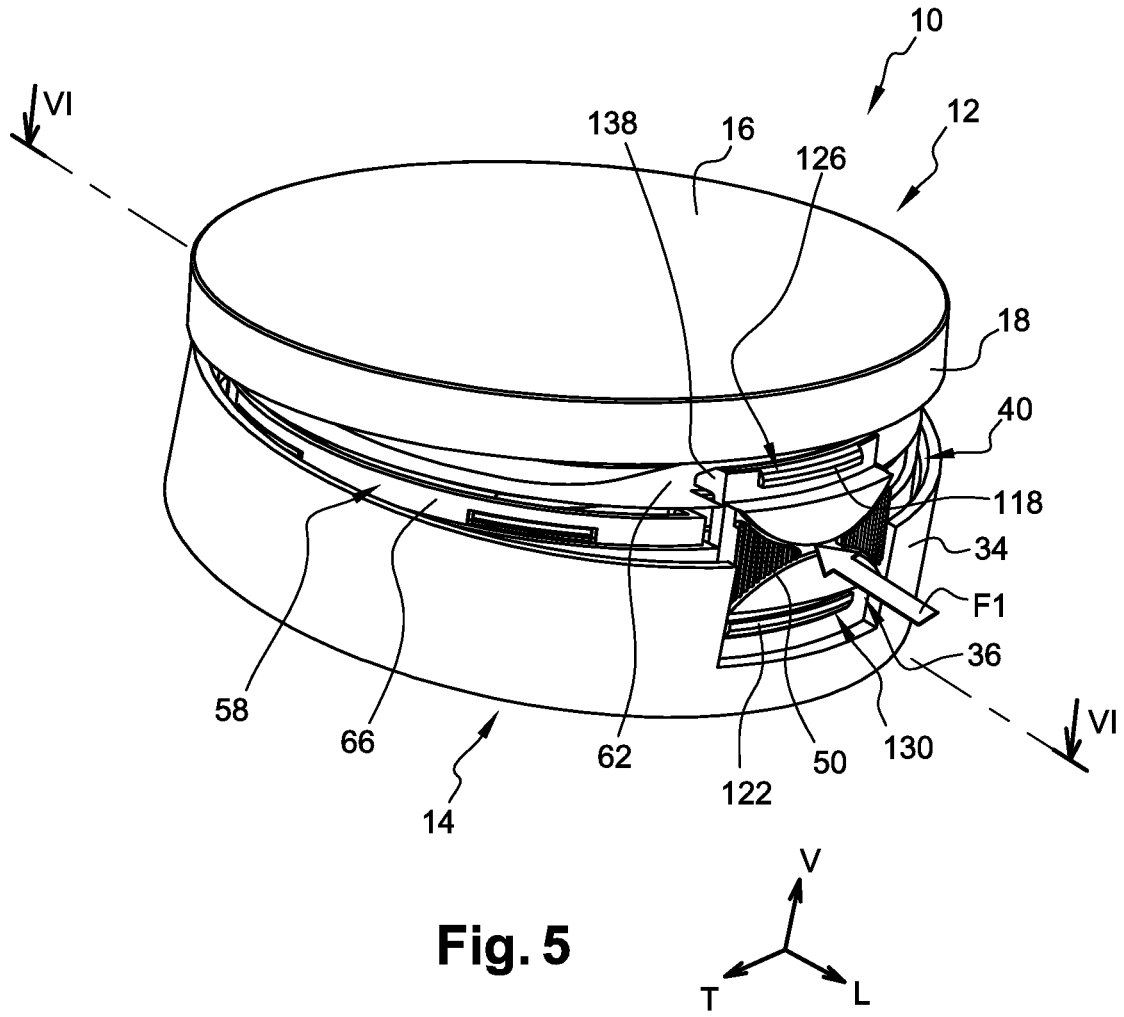
FIGS. 5 and 6 are respectively a perspective view and a cross-sectional view along the vertical VI-VI plane of longitudinal orientation that represent the case after a handling operation to open it and that illustrate a first open position, called "pre-opening position", of the lid and a first raised position of the dispensing device, which are respectively achieved after application on the control member of a first unlocking force provoking simultaneously the unlocking of the first locking means and of the second locking means.

The lid 12 of the case 10 is mounted rotationally mobile with respect to the base 14 about an axis O of rotation, respectively between a closed position (FIG. 3) and an open position (FIG. 5, 7 or 9).

The lid 12 includes a wall 16 and a circumferential edge 18. The wall 16 is flat, the wall 16 extending horizontally either in a plane (L, T) of the trihedron when the lid 12 is in a closed position, and the edge 18 extending vertically downwards.

The wall 16 of the lid 12 includes respectively an outer face 19 and an inner face 20.

Advantageously, the lid 12 includes at least one mirror 22 that is secured to the inside of the lid 12, against the inner face 20, by securing means 24.

The securing means 24 of the mirror 22 are, for example, made from two strips of double-sided adhesive tape, or by gluing, or in variant by any other equivalent securing means.

The mirror 22 includes a reflective face 26 intended to make it possible for the user see themselves, in particular for the purpose of putting on makeup using the cosmetic product P.

Advantageously, the case 10 includes at least one applicator 28 intended to be used to put on makeup with the cosmetic product P.

Preferably, the applicator 28 is here made from a sponge, for example made of foam, of which one face at least is used to apply the cosmetic product P.

In variant, the applicator 28 is made of a brush or any equivalent means intended for the application of a cosmetic product.

The base 14 includes at least one internal cavity 30. The cavity 30 has a volume that is, here, delimited by a bottom 32 and a circumferential edge 34 of the base 14.

The bottom 32 of the base 14 includes an internal face 31 that is mainly flat and an external face 33.

The edge 34 of the base 14 includes an opening 36 located towards the front and, longitudinally opposite the opening 36, an opening 38 located at the rear. The front opening 36 and the rear opening 38 are each mainly "U-shaped", open vertically upwards.

The case 10 includes a dispensing device 40 that is arranged between the lid 12 and the base 14.

The dispensing device 40 is mounted rotationally mobile between a lowered position (FIG. 3) and at least one raised position (FIG. 5, 7 or 9).

The lid 12 is mounted rotationally mobile with respect to the base 14 by means of first articulation means that are configured to form a hinge.

The first articulation means of the lid 12 include at least one first part 42 of the hinge that is secured to the lid 12 and one second part 44 of the hinge that is secured to the base 14.

The second part 44 of the hinge includes two leaves, respectively a left and a right leaf that are connected to the edge 34, the leaves transversally delimiting the rear opening 38 wherein is housed the first part of the hinge 42.

After assembly, the first part 42 of the hinge and the second part 44 of the hinge are connected by at least one pin, here by two pins 46, respectively left and right.

For this purpose, the first part 42 of the hinge includes at least one bore 43 and the second part 44 of the hinge includes at least one bore 45, which, here passing through each leaf, extend until they open onto the outer surface 34 of the base 14 to make it possible for the introduction, from the outside, of each of the pins 46.

The two pins 46 determine the rotation axis O of the lid 12, the rotation axis O being of a transversal orientation.

The dispensing device 40 is mounted rotationally mobile with respect to the base 14 by way of second articulation means that are configured to form a hinge.

The second articulation means of the dispensing device 40 include a first part 48 of a hinge.

Preferably, the first part 48 of the hinge is connected to the base 14 by the pins 46 of the first articulation means of the lid 12.

The first part 48 of the hinge includes at least one bore 49 for the pins 46.

Thus, the second part 44 of the hinge of the first articulation means of the lid 12 forms for the second means of articulation of the dispensing device 40 a second part of the hinge, to which the first part 48 of the hinge of the second articulation means is connected by the pins 46.

The first part 48 of the hinge of the second articulation means of the dispensing device 40 is configured to engage with the first part 42 of the hinge of the first articulation means of the lid 12.

Advantageously, the first articulation means of the lid 12 and the second articulation means of the dispensing device 40 have the same rotation axis O, a shared rotation axis that is here determined by the pins 46.

The dispensing device 40 includes a control member 50 that is intended to be actuated manually to command a dispensing of the cosmetic product.

In the embodiment, the control member 50 is a button or a push button intended to be actuated manually, in particular by at least one finger.

Figure 3:
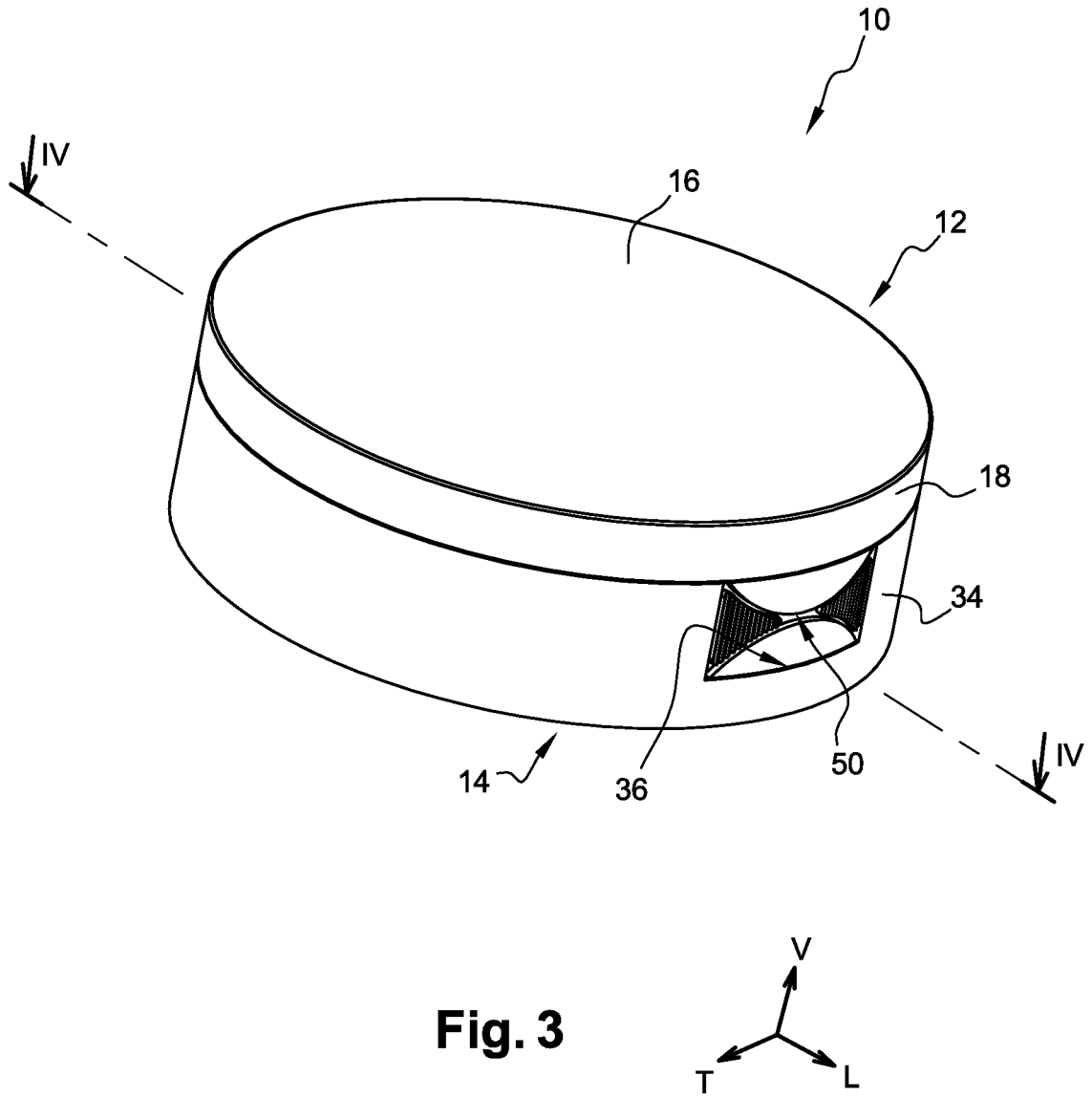
FIGS. 3 and 4 are respectively a perspective view and a cross-sectional view along the vertical IV-IV plane of longitudinal orientation that represent the case according to the embodiment and that illustrate the lid of the case in a closed position and the dispensing device in a lowered position, wherein the dispensing device is superimposed on the base.

As can be seen in FIG. 3, the control member 50 is mainly housed in the front opening 36 provided in the edge 34 of the base 14 so as to be accessible from the outside when the lid 12 of the case 10 is in a closed position.

Advantageously, the dispensing device 40 is configured to selectively dispense a determined dose of cosmetic product P.

The dose of cosmetic product P is delivered in the cavity 30 included in the base 14 when a predetermined force, here a thrust force, is applied onto the control member 50 as is explained in further detail below.

Preferably, the cosmetic product P is received in the cavity 30, which is here formed directly by the base 14.

The dispensing device 40 being arranged above the base 14, the flow from upstream to downstream of the cosmetic product P is advantageously the result of gravity pulling it to the cavity 30.

In non-represented variants, the base 14 includes a bottom 32, the inner surface 31 of which includes at least one concave portion to create a hollowed-out cavity, preferably positioned centrally and/or the base 14 includes a bottom 32 provided with at least one annular wall extending vertically upwards, protruding from the inner surface 31 to form a barrier intended to maintain the cosmetic product P at the centre of the cavity 30.

Advantageously, the base 14 includes protection means 52 intended to limit the risks of dispersion outside of the case 10 of the powdery cosmetic product P likely to be present inside the cavity 30.

Indeed, the cosmetic product P possibly present in the cavity 30 is free and consequently likely to be dispersed out of the cavity 30, in particular when transported in a bag, when the case 10 can find itself in any position.

The protection means 52 are preferably arranged at the level of the rear opening 38 to limit the risks of powdery cosmetic product P being dispersed at the level of the hinge.

The protection means 52 include, for example, an edge 54 that, from the lower end of the leaves forming the second part 44 of the hinge, extends horizontally towards the inside of the cavity 30 to create a screen preventing the passage of the cosmetic product P.

Figure 4:
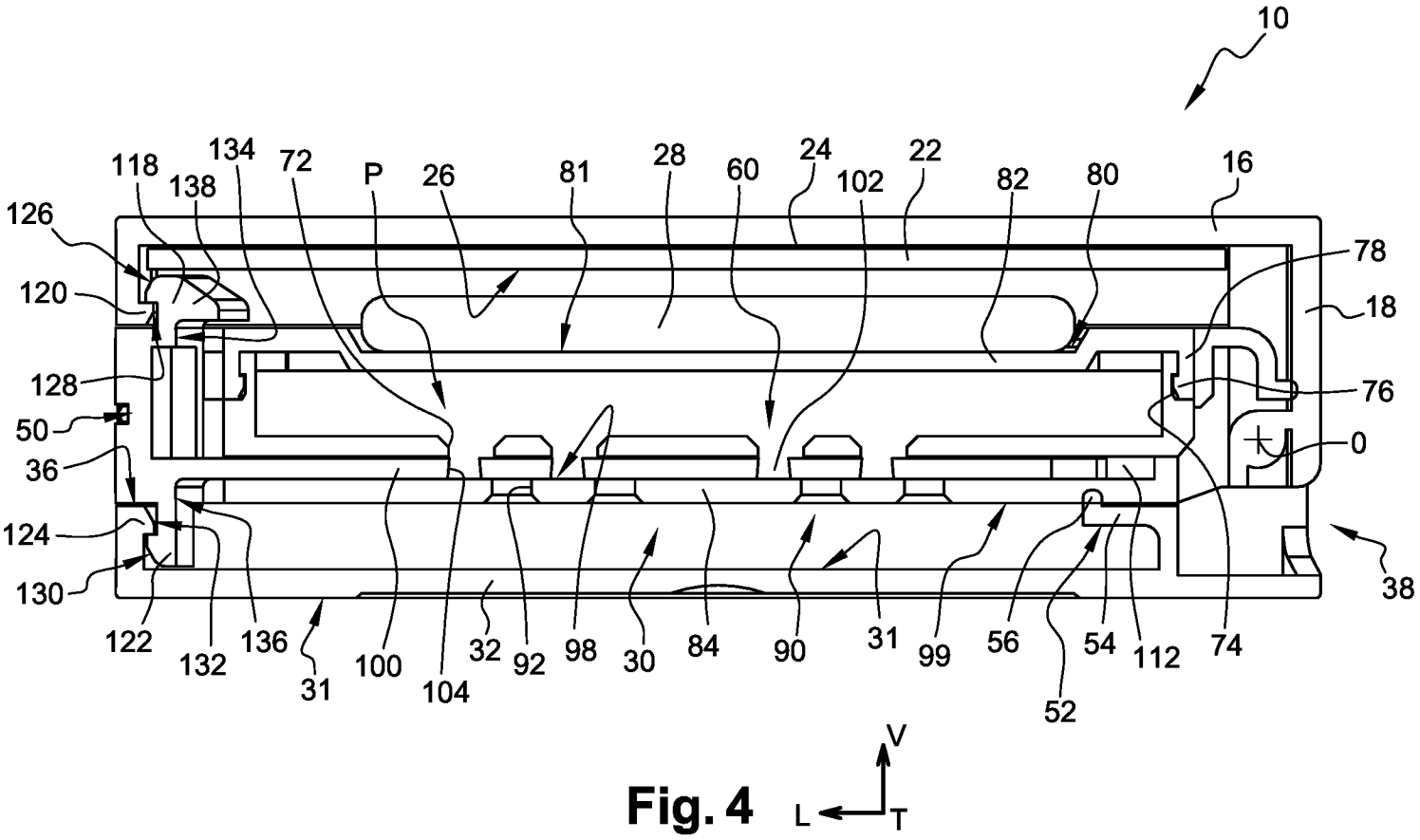

Preferably, the edge 54 is provided at the free end thereof with a lip 56 intended to engage with the dispensing device 40 occupying the lowered position that is illustrated in FIGS. 3 and 4.

Advantageously, the case 10 does not include such protection means at the level of the front opening of the base 36, as the control member 50 forms a screen to the passage of the cosmetic product P of the cavity 30 towards the outside of the case 10.

As a non-represented variant, the cavity 30 belongs to an additional part, such as a cup, mounted inside the base 14 so as to receive the powdery cosmetic product P dispensed by the dispensing device 40.

Preferably, the cup is mounted mobile between at least one lowered position and one raised position.

The lowered position corresponds to a position wherein an upper side of the cup engages with the dispensing device occupying the lowered position, while the raised position corresponds to a position towards which the cup is drawn by the elastic return means when the dispensing device is in the raised position.

Preferably, the elastic return means are, for example, arranged between the cup and the bottom of the base.

In such a variant, the cup is configured such that, when it is in a lowered position, an upper side of the cup engages with a lower adjacent face of the dispensing device.

Advantageously, such a cup makes it possible to reduce the risks of dispersion. Preferably, the upper side of the cup includes sealing means, such as a seal capable of withstanding deformations.

In such a variant, the abovementioned protection means 52 are advantageously suppressed.

A preferred embodiment of such a dispensing device 40 configured to deliver selectively a dose of powdery cosmetic product P is described below.

The dispensing device 40 includes a reservoir 60 intended to contain a powdery cosmetic product P.

The dispensing device 40 includes a bucket 58 delimiting at least partially the reservoir 60, which is closed by a cap 62.

The bucket 58 includes a wall 64, the periphery of which is delimited by a side 66 that extends vertically on either side of the wall 64.

The side 66 presents a tiered profile, a lower part of the side 66 being connected to an upper part by a shoulder 68 intended to engage with the cap 62.

The wall 64 of the bucket 58 includes a lower face 65 and an upper face 67.

The wall 64 of the bucket 58 includes a supply network 70 formed by orifices 72 that communicate with the reservoir 60 and consequently with the cosmetic product P.

Preferably, the reservoir 60 is made of two parts which, respectively formed by the bucket 58 and the cap 62, are assembled by first securing means.

Preferably, the first securing means of the bucket 58 and of the cap 62 are configured to achieve securing by snap-fitting.

The first securing means include, on the one hand, notches 74 arranged in the upper part of the side 66 of the bucket 58 wherein are engaged lugs 76, carried by a side 78 of the cap 62.

After assembly, the free end of the side 78 of the cap 62 bears against the shoulder 68 of the side 66 of the bucket 58.

Preferably, the cap 62 is secured to the bucket 58 so that it cannot be removed. As a variant, the cap 62 is secured to the bucket 58 so that it can be removed, such that the removable cap 62 thus makes it possible to refill the reservoir 60 with cosmetic product P.

In variant, the reservoir 60 is made of one single part.

Advantageously, the cap 62 includes a housing 80 configured to receive all or part of at least one applicator 28 of the cosmetic product P.

The housing 80 of the applicator 28 is provided in the upper part of the cap 62. The housing 80 is delimited at the bottom by a wall 82 of the cap 62 and on the periphery by an upper part of the side 78.

The wall 82 of the bucket 62 includes an upper face 81 and a lower face 83, respectively flat here.

Preferably, the housing 80 of the cap 62 receives only one part of the applicator 28, the other part being received inside the lid 12 provided with the mirror 22, such that the case 10 has generally reduced dimensions.

Advantageously, the mirror 22 and/or the applicator 28 are arranged in the upper part of the case 10, between the lid 12 and the dispensing device 40, such that the mirror and/or the applicator 28 are isolated from the cosmetic product P that is present, in particular in the cavity 30 of the base 14, or in the lower part of the case 10.

Such a design of the case 10 makes it possible to protect the mirror 22 and/or the applicator 28 from risks of soiling by the cosmetic product P, and the case 10 has good cleanliness and hygiene properties for the user thereof.

Advantageously, the cap 62 includes at least one zone, preferably a transparent zone, provided in the wall 82, so as to make it possible to visually inspect, through the zone, the quantity of cosmetic product P present in the reservoir 60 of the dispensing device 40.

The dispensing device 40 includes a sieve 84 that includes a flat wall 86, the periphery of which is delimited by a side 88.

Advantageously, the sieve 84 includes a dispensing network 90 formed by orifices 92 communicating with the cavity 30 that the base 14 includes.

The orifices 92 of the sieve 84, which is located downstream, are offset with respect to the orifices 72 of the bucket 58, which is located upstream, so as to prevent a direct flow of the cosmetic product P from the reservoir 60 to the cavity 30.

The bucket 58 and the sieve 84 are assembled by way of second securing means, preferably similar to the first securing means of the cap 62, i.e. snap-fitting securing means.

The second securing means include notches 94 provided in the side 88 of the sieve 84 wherein are received the lugs 96, the lugs 96 being carried by the lower part of the side 66 of the bucket 58, and arranged inside the latter.

The wall 86 of the sieve 84 includes respectively an upper face 98 and a lower face 99.

Advantageously, the dispensing device 40 includes a dosage plate 100 to which the control member 50 is secured.

Preferably, the control member 50 is made of one single part, made of one piece with the dosage plate 100.

The dosage plate 100 includes a dosage network 102 formed by through-orifices 104 intended to transfer the dose of cosmetic product P from the reservoir 60 to the cavity 30.

The dosage plate 100 is arranged between the bucket 58 and the sieve 84 and is free to move with respect to the bucket 58 and the sieve 84, which are secured together.

The dispensing device 40 forms one single assembly that is mounted mobile about the rotation axis O between at least the lowered position and the raised position.

In the dispensing device 40, the bucket 58 and the cap 62 delimiting the reservoir 60 are secured together by the first securing means 74, 76, while the bucket 58 is also secured to the sieve 84 by the second securing means 94, 96, thereby forming the single assembly including the reservoir 60 and dispensing means including the bucket 58, the dosage plate 100 and the sieve 84.

The dosage plate 100 is mounted mobile in translation along the longitudinal orientation between at least a dosage position and a dispensing position.

The dosage position of the plate 100 corresponds to a position wherein the orifices 104 of the dosage network 102 of the plate 100 are aligned with the orifices 72 of the supply network 70 of the bucket 58 to receive a dose of cosmetic product P from the reservoir 60.

The dispensing position of the plate 100 corresponds to a position wherein the orifices 104 of the dosage network 102 of the plate 100 are aligned with the orifices 92 of the dispensing network 90 to dispense the dose of cosmetic product P into the cavity 30.

In the dosage position, as illustrated on FIG. 4, the orifices 104 of the dosage network 102 of the dosage plate 100 are closed by the upper face 98 of the sieve 84.

Figure 8:
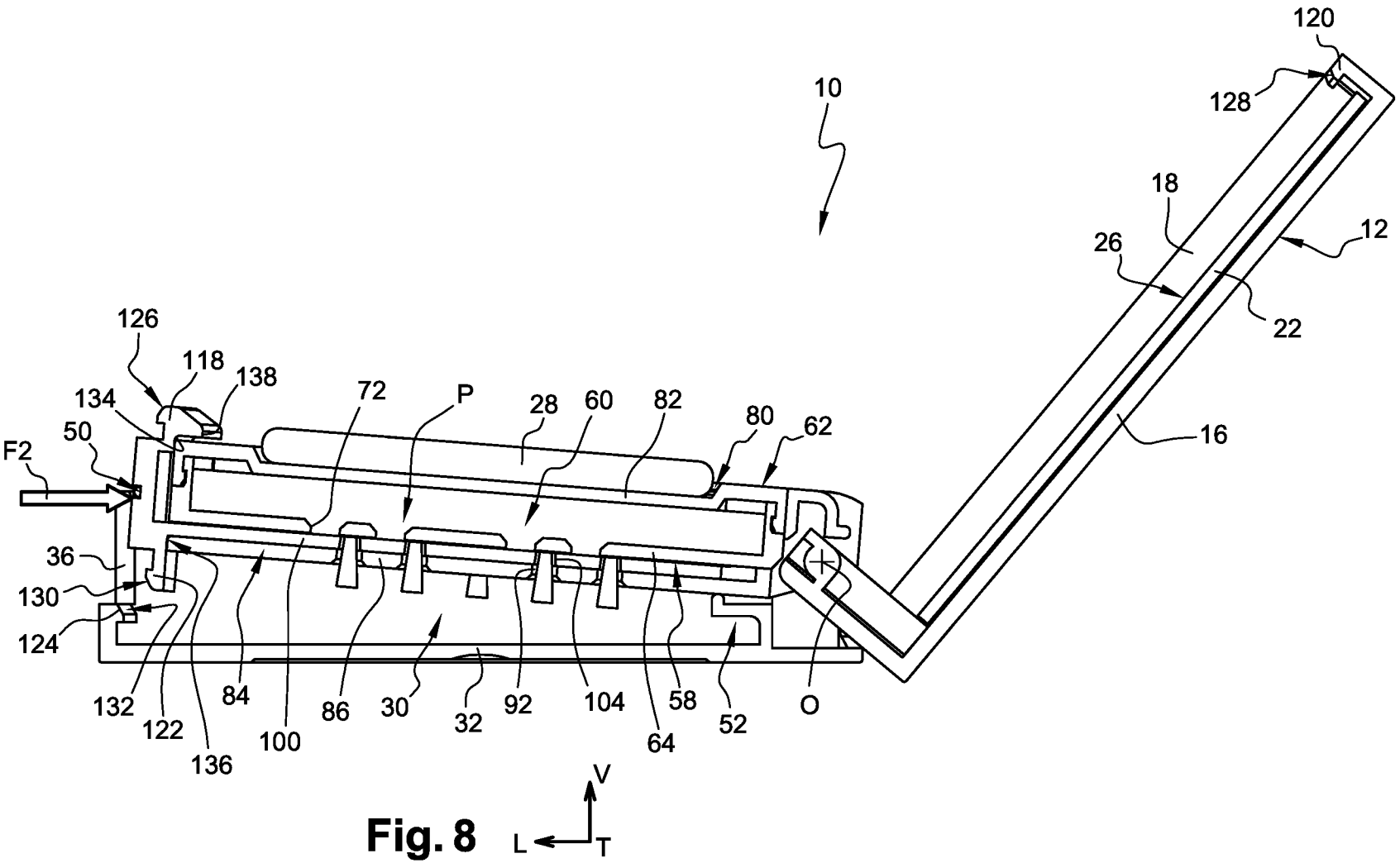

In the dispensing position, such as illustrated in FIG. 8, the orifices 104 of the dosage network 102 of the dosage plate 100 are closed by the lower face 65 of the bucket 58.

Preferably, the dispensing device 40 includes translational guide means of the dosage plate 100.

The guide means of the dosage plate 100 include, for example, at least one rib 106 configured to engage with at least one slot 108.

The dosage plate 100 includes at least one rib 106, here two ribs, one left and one right, that protrude from a lower face 105 of the plate 100, the two ribs 106 extending in parallel along the longitudinal orientation.

Preferably, the sieve 84 includes at least one guide slot 108, in this case two slots 108, one left and one right, that extend in parallel along the longitudinal direction.

Thanks to the guide means 106, 108, the dosage plate 100 is guided longitudinally in translation between the dosage and dispensing positions.

The dosage plate 100 is commanded to move from a dosage position towards a dispensing position by selectively actuating the control member 50.

Advantageously, the dosage plate 100 is automatically returned towards the dosage position by elastic return means 110.

Preferably, the elastic return means 110 returning the dosage plate 100 to the dosage position are formed by two elastically-deformable arms 112.

Advantageously, the arms 112 are made of one single part, integrally formed with the dosage plate 100. The arms 112 are arranged longitudinally at the rear of the dosage plate 100 and bear against the side 88 of the sieve 84.

The functioning of the dispensing device 40, resulting from the manual application of a determined force on the control member 50 to cause the sliding of the dosage plate 100 from the dosage position to the dispensing position of a dose of cosmetic product P is described below in further detail.

The case 10 for a cosmetic product includes first locking means 114 configured to lock the lid 12 in a closed position, the closed position being shown in FIGS. 3 and 4.

The case 10 for a cosmetic product includes second locking means 116 configured to lock the dispensing device 40 in a lowered position, the lowered position being more specifically illustrated in FIG. 4.

The first locking means 114 of the lid 12 and the second locking means 116 of the dispensing device 40 are of the controlled type, i.e. at least the locking thereof is controlled by actuating manually on a control member.

The first locking means 114 and the second locking means 116 are respectively mounted mobile between a locked position and an unlocked position.

According to the invention, the control member 50 of the dispensing device 40 is configured to command the unlocking of the first locking means 114 of the lid 12 and the unlocking of the second locking means 116 of the dispensing device 40.

Advantageously, the control member 50 is a multi-purpose member that commands, on the one hand, a double unlocking and, on the other hand, the dispensing of the cosmetic product P.

At least one part of the first locking means 114 of the lid 12 and one part of the second locking means 116 of the dispensing device 40 are secured to the control member 50.

Preferably, the first locking means 114 include at least one locking pin 118, called "upper" locking pin, which is carried by an upper part of the control member 50 and protrudes forwards.

The upper locking pin 118 is mounted mobile in translation with the control member 50 (secured to the dosage plate 100) respectively between the locked position and the unlocked position of the first locking means 114.

In the locked position, the upper locking pin 118 engages with at least one complementary notch 120 of the lid 12, in this case provided inside the side 18 of the lid 12 from which the notch 120 protrudes backwards.

Advantageously, the upper locking pin 118 is returned automatically to the locked position, urged forwards by the elastic return means 110 of the dosage plate 100.

Preferably, the second locking means 116 include at least one locking pin 122, called "lower" locking pin, which is carried by the control member 50 and protrudes forwards.

The lower locking pin 122 is mounted mobile in translation with the control member 50 (secured to the dosage plate 100) respectively between the locked position and the unlocked position of the second locking means 116.

In the locked position, the lower locking pin 122 engages with at least one complementary notch 124 of the base 14, in this case provided at the level of the front opening 36, inside the side 34 of the lid 12 from which the notch 124 protrudes backwards.

Advantageously, the lower locking pin 122 is returned automatically to the locked position, urged forwards by the elastic return means 110 of the dosage plate 100.

In the embodiment, the return means towards the locked position of the first locking means 114 and of the second locking means 116 are formed by the elastic return means 110 of the dosage plate 100 of the dispensing device 40.

Preferably, the first locking means 114 and the second locking means 116 have similar configurations such that the actuating of the control member 50 simultaneously causes the respective unlocking thereof.

Advantageously, the first locking means 114 and/or the second locking means 116 are configured to automatically lock when the case 10 is closed by handling, without having to manually actuate the control member 50.

Preferably, the upper locking pin 118 includes a frustoconical surface 126 and/or the associated notch 120 of the lid 12 includes a frustoconical surface 128.

Preferably, the lower locking pin 122 includes a frustoconical surface 130 and/or the associated notch 124 of the base 14 includes a frustoconical surface 132.

Advantageously, the dispensing device 40 includes end-of-motion abutment means that intervene when the dosage plate 100 reaches the dispensing position.

Preferably, the abutment means are secured to the control member 50, which includes a first abutment face 134 and/or a second abutment face 136.

Advantageously, the control member 50 includes a first abutment face 134 and a second abutment face 136, which, extending vertically, are arranged at the rear of the control member 50, on the opposite side of the locking pins 118 and 122.

When the dosage plate 100 reaches the dispensing position, the first abutment face 134 comes into contact with a part of the side 78 of the cap 62, or in variant with a part of the side 66 of the bucket 58, depending on the design of the reservoir 60, and the second abutment face 136 comes into contact with a part of the sieve 84 that is located at the front and wherein the side 88 is interrupted.

Thanks to such end-of-motion abutment means 134, 136, the actuating of the control member 50 is facilitated for the user.

In addition, the elastic return means 110 are protected against the application of excessive force on the control member 50.

Preferably, the control member 50 includes a side 138, which, protruding longitudinally backwards from the upper part thereof, is configured here to cover the cap 62 to conceal the gap existing between the control member 50 and the dispensing device 40, so as to hide it and preserve the aesthetics of the case 10.

The functioning of the case 10 according to the embodiment described above will be described in further detail below, in particular with reference to FIGS. 1 and 2.

In this embodiment, the unlocking of the first locking means 114 and of the second locking means 116 is preferably achieved simultaneously when the control member is actuated manually, i.e. in a double unlocking action.

However, the unlocking and the dispensing of a dose of cosmetic product are advantageously dissociated, i.e. in particular the actuating of the control member 50 to command the unlocking does not systematically cause a dispensing of the cosmetic product P.

Indeed, when an opening manipulation is performed, for example, depending on the force applied on the control member 50, either only the double unlocking occurs, or the double unlocking and the dispensing of a dose of cosmetic product P occur successively.

Advantageously, the dispensing device 40 is configured such that the application of a first force F1, called "unlocking" force, on the control member 50, causes an unlocking of the first locking means 114 and of the second unlocking means 116.

Advantageously, the application on the control member 50 of a second force F2, called "dispensing" force, greater to the first unlocking force F1, causes the dispensing of a dose of cosmetic product P thanks to which the dispensing of cosmetic product P is dissociated from the opening and closing operations of the case.

In the embodiment, the control member 50 is a pushbutton such that the control member 50 is actuated by the manual application of a thrust force, oriented longitudinally and directed from front to back.

Such as illustrated in FIGS. 3 and 4, the case 10 is closed, in particular capable of being easily transported, the case 10 forming an "all-in-one" nomad object, namely at least one mirror 22, one applicator 28 and one powdery cosmetic product P selectively delivered, on demand, by the dispensing device 40 completely integrated in the case 10.

In FIGS. 3 and 4, the lid 12 of the case 10 occupies the closed position, the first locking means 114 being in a locked position, while the dispensing device 40 occupies the lowered position, the second locking means 116 being in a locked position.

The casing 10 is thus handled in the following manner to ensure the opening thereof. A force, at least equal to the first unlocking force F1, is applied to the control member 50, which causes the simultaneous unlocking of the first locking means 114 and the unlocking of the second locking means 116.

Figure 6:
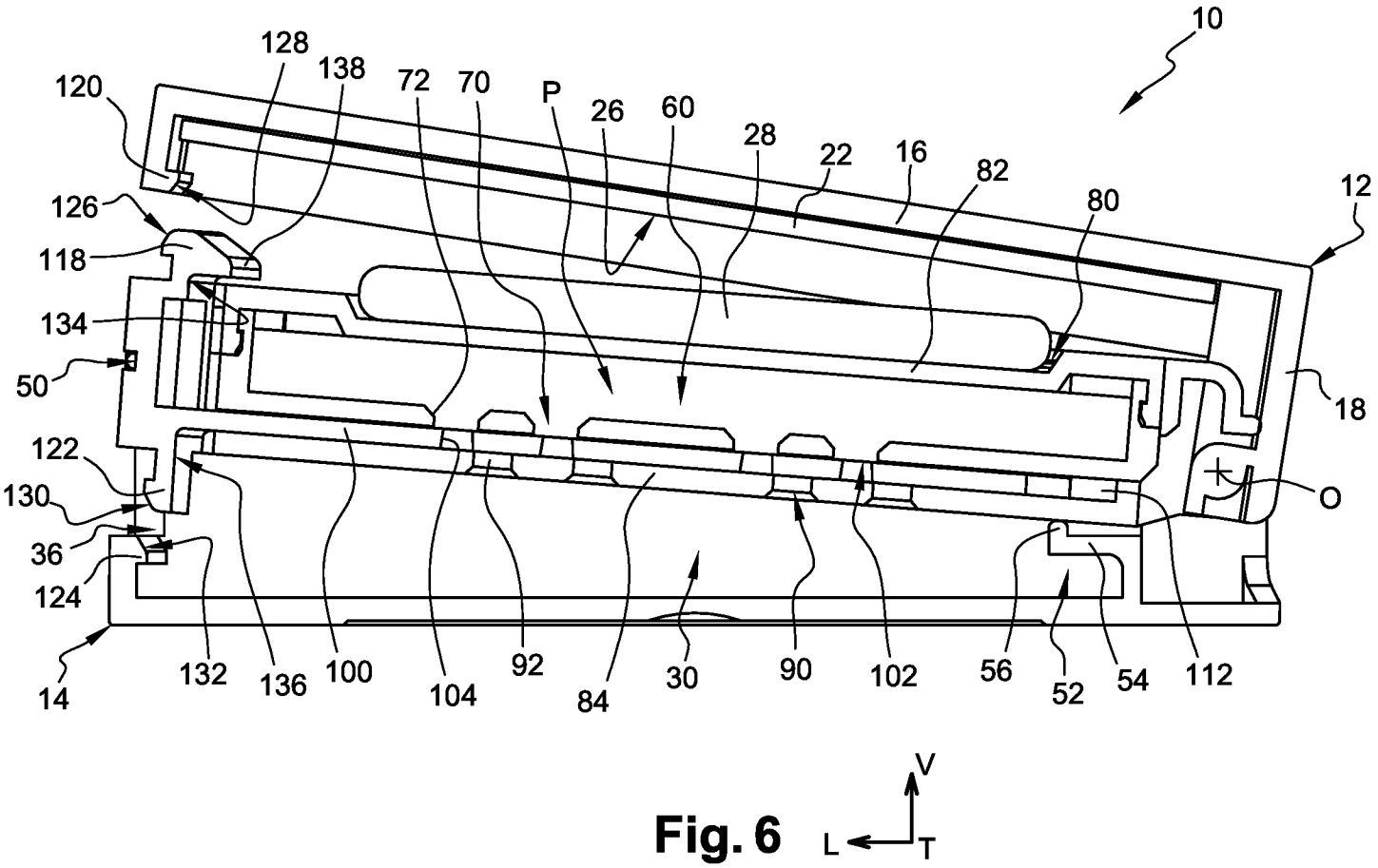

Such as illustrated in FIGS. 5 and 6, the lid 12 of the case 10 then occupies a first open position, called "pre-opening" position, the first locking means 114 being in an unlocked position, while the dispensing device 40 occupies a first raised position, the second locking means 116 also being in an unlocked position.

FIG. 6 illustrates the dosage plate 100 in the dosage position wherein the orifices 104 of the dosage network 102 of the plate 100 are aligned with the orifices 72 of the supply network 70 of the bucket 58 to receive a dose of cosmetic product P from the reservoir 60.

If the thrust force at least equal to the first unlocking force F1 applied on the control member 50 remains less than the second dispensing force F2, then only the double unlocking is achieved, without dispensing of the cosmetic product P.

The application of a force at least equal to the first force F1 on the control member 50 causes the sliding, from front to back, of the dosage plate 100 according to a first motion, called "unlocking" motion.

The dosage plate 100 thus occupies an intermediate position between the dosage position and the dispensing position.

Advantageously, the first locking means 114 and the second locking means 116 are configured such that the first unlocking motion is reduced, preferably short.

Advantageously, the dispensing device 40 includes a dosage network 102 of the plate 100 and a dispensing network 90 of the sieve 84 that are configured to not communicate with one another when the dosage plate 100 occupies the intermediate position, which is reached after the first unlocking motion.

In a non-limiting manner, the application of a force at least equal to the first force F1 but less than the second dispensing force F2 corresponds, for example, to the actuating that is performed by a user who seeks to use the mirror 22 housed inside the lid 12 of the case 10.

For this purpose, once the double unlocking is complete, the lid 12 is raised manually to be driven rotationally about the axis O from the first pre-opening position to at least one other open position such as the second open position, called "maximum opening" position, illustrated in FIGS. 7 and 8.

In this case, the dispensing device 40 is maintained in the first raised position occupied previously in FIGS. 5 and 6, in order in particular not to conceal the mirror 22.

If, having inspected themselves or not in the mirror 22, the user seeks to use the cosmetic product P for makeup purposes using the applicator 28, the dispensing of at least one dose can then be commanded selectively by applying an adequate thrust force on the control member 50, i.e. a force greater than or equal to the second dispensing force F2.

It must be noted, that such a force at least equal to the second dispensing force F2 can be applied or not in the continuity of the initial force at least equal to the first force F1 having caused the double unlocking.

Such as indicated previously, the unlocking and dispensing functions are advantageously dissociated and commanded selectively, independently from one another.

The application of the initial force can, for example, be intentionally interrupted after having achieved the double unlocking, in order to use the mirror 22 or to examine the contents of the cavity 30. The dispensing device 40 is then lifted to determine whether a dispensing of cosmetic product is necessary or not.

Indeed, the cavity 30 can include a residual quantity of cosmetic product P, which was not fully used, and the dispensing of a new dose is therefore not required, in particular if the user seeks to perform a simple retouch of makeup.

Advantageously, the dispensing command of a dose of cosmetic product P is independent of the position of the first locking means 114 and of the second locking means 116, which are automatically returned to a locked position by the elastic return means 110 of the dosage plate 100.

When the command for the dispensing of a dose of cosmetic product P is not performed subsequently to the double unlocking, the first motion corresponding to the unlocking must be repeated in order to initiate a second motion that corresponds to the dispensing.

Preferably, the dispensing command is performed when the dispensing device 40 is in the first raised position illustrated in FIGS. 6 and 8, such that the delivered dose of cosmetic product P falls into the cavity 30 that the base 14 includes.

Such as illustrated in FIGS. 7 and 8, the manual application on the control member 50 of a thrust force greater than or equal to the second dispensing force F2 causes the dispensing of a dose of cosmetic product P.

The application on the control member 50 of this force at least equal to the second force F2 causes the sliding of the dosage plate 100, longitudinally from front to back, from the dosage position to the dispensing position.

Advantageously, the application of the second force F2 is made particularly easy for the user, as no accurate control of the force is required, and the force can be applied without restraint.

Indeed, the user can exert a significant force on the control member 50 without worrying about applying excessive force, thanks to the end-of-motion abutment means formed by the abutment faces 134, 136.

A comparison between FIGS. 6 and 8 advantageously makes it possible to visualize the removal of the gap initially present between the rear of the control member 50 and the dispensing device 40, and the abutment created by the faces 134 and 136.

The application on the control member 50 of a thrust force at least equal to the second dispensing force F2 causes the sliding of the dosage plate 100 to the dispensing position.

In the dispensing position and as illustrated in FIG. 8, the orifices 104 of the dosage network 102 of the plate 100 are advantageously aligned with the orifices 92 of the dispensing network 90 of the sieve 84, the dose of cosmetic product P flowing by gravity towards the cavity 30.

The command for the dispensing of a dose of cosmetic product P can be performed once, but also repeated depending on the desired quantity of cosmetic product P.

Advantageously, the abutment of the faces 134 and 136 of the control member 50 informs the user that the dispensing of the dose is complete, and that the application of force is no longer required.

Advantageously, when the user stops applying force after dispensing, the dosage plate 100 is automatically returned to the dosage position by the elastic return means 110.

As soon as the dosage plate 100 occupies once again the dosage position, the orifices 104 of the dosage network 102 are automatically filled with cosmetic product P, which then flows, owing to the alignment thereof, from the orifices 72 of the supply network 70 of the bucket 58 communicating with the reservoir 60.

The dispensing device 40 is then once again ready to dispense a dose of cosmetic product P.

Once the dispensing of at least one dose of cosmetic product P is achieved in the cavity 30, the user can take hold of the applicator 28 and manually raise the dispensing device 40 to access the cosmetic product P contained in the cavity 30.

Figure 10:
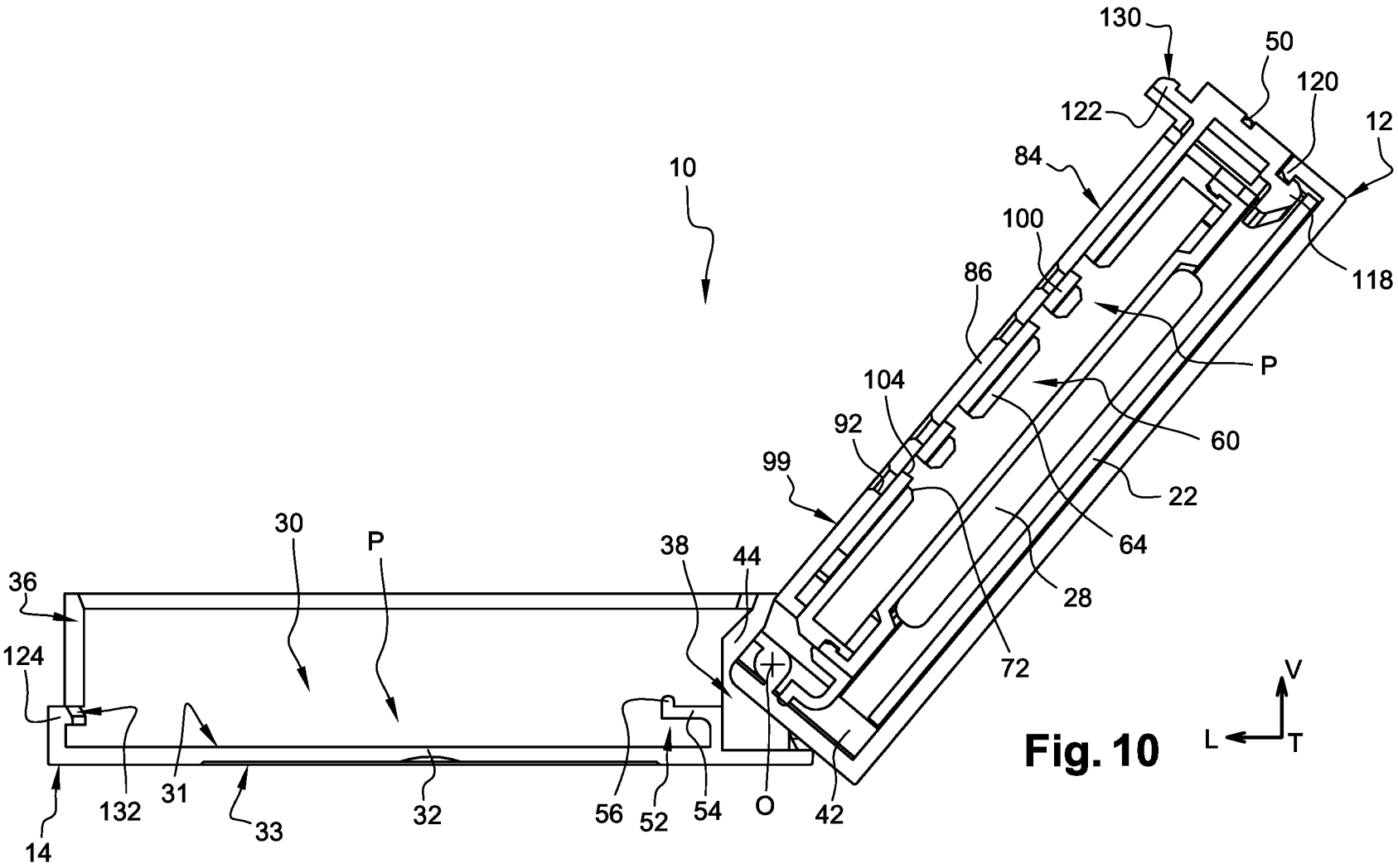

The dispensing device 40 is driven about the rotation axis O from the first raised position previously occupied to a second raised position, such as that shown in FIGS. 9 and 10.

Once the cosmetic product P present in the cavity 30 is collected using the applicator 28, the dispensing device 40 can be lowered as necessary, in particular for the purpose of using the mirror 22.

After having used the case 10, the closing operation is advantageously performed by implementing simplified actions, without having to actuate the control member 50, by lowering the lid 12 from the open position to a closed position.

The closing of the case 10 is, for example, achieved by pressing on the lid 12 or by clamping the lid 12 and the base 14 against one another.

Once the closing the case 10 is complete, the frustoconical surfaces 126 and 128 forming ramps engage with one another to cause the upper locking pin 118 to retract, preferably due to the backwards motion of the dosage plate 100 towards an unlocked position against the elastic return means 110.

In variant, the retraction of the upper locking pin 118 is achieved by means of elastic deformation, in particular of the upper part of the control member 50 including the upper locking pin 118.

In a non-limiting manner, the retraction of the upper locking pin 118 can result from a combination of the backwards motion of the plate 100 and an elastic deformation.

The retraction is then followed by the automatic return of the upper locking pin 118 to the initial position thereof, i.e. a locked position, thereby enabling the locking without actuating the control member 50.

In the event of backwards motion of the dosage plate 100, the automatic return to a locked position of the upper locking pin 118 is caused by the elastic return means 110 of the dosage plate.

Advantageously, the lower locking pin 122 includes a frustoconical surface 130 and the associated notch 124 of the base 14 includes a frustoconical surface 132.

Preferably, the upper locking pin 118 and the lower locking pin each include a technical shape, such as a frustoconical surface, configured to achieve automatic locking without actuating the control member 50.

Similarly to the upper locking pin 118, the frustoconical surfaces 130 and 132 of the lower locking pin 122 engage with one another during handling operations to close the case 10, to cause the automatic retraction of the lower locking finger 122.

Preferably, the retraction is the result of the backwards motion of the dosage plate 100 towards the unlocked position against the elastic return means 110 that ensure the automatic return of the lower locking pin 122.

In variant, the retraction of the lower locking pin 122 is achieved by elastic deformation, or by the combination of the backwards motion of the dosage plate 100 and elastic deformation.

Advantageously, at least one of the locking pins 118, 122 and/or at least one of the associated notches 120, 124 is provided with a technical shape, such as at least one frustoconical surface, preferably each of the locking pins 118, 122 and the associated notches 120, 124.

Of course, the embodiment described above is in no way limiting.

In a non-represented variant, the first locking means and the second locking means are configured such that the double locking and the dispensing of cosmetic product are performed simultaneously and not successively, in a dissociated manner.

In such a variant, each manipulation to open the case by manually actuating the control member consequently causes the dispensing of a cosmetic product in the cavity.

By comparison with the embodiment, the operating gesture is however also simplified, since there is only one determined force to apply to cause one single unlocking motion, which is the same as the dispensing motion performed by the dispensing plate between the dosage position and the dispensing position.

Such as indicated previously, the dispensing device is advantageously configured to deliver a determined dose of cosmetic product.

In variant, the dispensing device could be simplified by including only two parts (and not three), a first fixed part and a second part which can be moved from an inactive position wherein the cosmetic product is not dispensed and an active position wherein the cosmetic product is dispensed.

In such a variant, the quantity of cosmetic product is however no longer accurately controlled since the flow of cosmetic product in the active position is only interrupted when force is no longer applied, making it possible for the second part which can be moved to be advantageously returned automatically towards the inactive position by the associated return means. Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

The invention claimed is:

1. A case for a cosmetic product, in particular a powdery cosmetic product, comprising:

a lid that is mounted rotationally mobile with respect to a base between at least one closed position and one open position of the case, first locking means to lock the lid in a closed position, a dispensing device which, arranged between the lid and the base, is mounted rotationally mobile with respect to the base between at least one lowered position and one raised position, said dispensing device comprising a control member configured for actuation to command a dispensing of the cosmetic product, second locking means to lock said dispensing device in the lowered position, wherein said control member of the dispensing device is configured to command the unlocking of the first locking means of the lid and the unlocking of the second locking means of the dispensing device.

2. The case according to claim 1, wherein the dispensing device comprises a reservoir intended to contain a cosmetic product.

3. The case according to claim 1, wherein the base contains a cavity intended to receive the cosmetic product dispensed by said dispensing device.

4. The case according to claim 1, wherein the dispensing device is configured to selectively dispense a determined dose of cosmetic product.

5. The case according to claim 1, wherein the lid is mounted rotationally mobile with respect to the base by way of first articulation means and the dispensing device is mounted rotationally mobile with respect to the base by way of second articulation means, said first articulation means and second articulation means having the same axis of rotation.

6. The case according to claim 1, wherein the dispensing device comprises:

a bucket delimiting at least partially said reservoir and intended to contain said cosmetic product, which is closed by a cap, said bucket comprising a supply network formed by orifices in communication with the reservoir, a sieve comprising a dispensing network formed by orifices in communication with a cavity that the base comprises, said orifices of the sieve being offset with respect to the orifices of the bucket so as to prevent a direct flow of the cosmetic product from the reservoir to said cavity that the base comprises, and a dosage plate which, secured to said control member, comprises a dosage network formed by through-orifices, said dosage plate being arranged between the bucket and the sieve and mounted mobile in translation between at least:

a dosage position wherein the orifices of the dosage network of the plate are aligned with the orifices of the supply network of the bucket to receive a dose of cosmetic product from the reservoir and a dispensing position wherein the orifices of the dosage network of the plate are aligned with the orifices of the dispensing network to dispense said dose of cosmetic product into the cavity.

7. The case according to claim 6, wherein the dispensing device comprises translational guide means of the dosage plate.

8. The case according to claim 6, wherein the dosage plate is commanded to move from a dosage position towards a dispensing position by actuating said control member.

9. The case according to claim 6, wherein the dosage plate is automatically returned to the dosage position by the elastic return means.

10. The case according to claim 9, wherein the first locking means and the second locking means are commanded from a locked position to an unlocked position by actuating said control member and in that the first locking means and the second locking means are automatically returned to said locked position by the elastic return means of the dosage plate.

11. The case according to claim 1, wherein the first locking means and/or the second locking means are configured to automatically lock when the case is closed by handling, without having to manually actuate the control member.

12. The case according to claim 6, wherein the cap comprises a housing configured to receive, at least partially, an applicator of said cosmetic product.

13. The case according to claim 6, wherein the cap comprises at least one transparent zone so as to make it possible to visually inspect, through said zone, the quantity of cosmetic product present in the reservoir of the dispensing device.

14. The case according to claim 1, wherein the dispensing device is configured such that the application of a first unlocking force on said control member, causes an unlocking of the first locking means and an unlocking of the second locking means and the application on said control member of a second dispensing force greater than said first unlocking force causes the dispensing of the cosmetic product.

15. The case according to claim 14, wherein the application of the first unlocking force on said control member simultaneously causes the unlocking of the first locking means and of the second locking means.

* * * * *